US008350479B1

(12) United States Patent
Brazille, II

(10) Patent No.: US 8,350,479 B1
(45) Date of Patent: Jan. 8, 2013

(54) EMERGENCY LIGHT BULB

(76) Inventor: Austin T. Brazille, II, Carson, CA (US)

( * ) Notice: Subject to any disclaimer, the term of this patent is extended or adjusted under 35 U.S.C. 154(b) by 275 days.

(21) Appl. No.: 12/759,773

(22) Filed: Apr. 14, 2010

(51) Int. Cl.
*F21L 4/04* (2006.01)
*H01Q 1/26* (2006.01)

(52) U.S. Cl. ..... 315/34; 362/198

(58) Field of Classification Search ..... 315/34–36, 315/129–133, 200 R, 185 R, 185 S, 7; 362/197–199, 362/202, 203, 227, 249.01, 800, 7
See application file for complete search history.

(56) References Cited

U.S. PATENT DOCUMENTS

| | | | | |
|---|---|---|---|---|
| 652,509 | A | 6/1900 | Cox | |
| 4,547,761 | A | 10/1985 | Jones | |
| 4,855,723 | A | 8/1989 | Fritz et al. | |
| 5,270,698 | A | 12/1993 | Hoyle et al. | |
| D349,256 | S | 8/1994 | Bellinger et al. | |
| D360,845 | S | 8/1995 | Smith et al. | |
| 5,489,891 | A * | 2/1996 | Diong et al. | 340/567 |
| 5,587,704 | A | 12/1996 | Foster | |
| D384,589 | S | 10/1997 | Loach | |
| 5,806,965 | A * | 9/1998 | Deese | 362/249.04 |
| 5,880,672 | A | 3/1999 | Weaver | |
| 5,991,363 | A | 11/1999 | Thomson | |
| 7,520,634 | B2 * | 4/2009 | Ducharme et al. | 362/276 |
| 7,642,730 | B2 * | 1/2010 | Dowling et al. | 315/292 |
| 8,240,885 | B2 * | 8/2012 | Miller | 362/294 |
| 2010/0056078 | A1 * | 3/2010 | Feldman et al. | 455/90.3 |

* cited by examiner

*Primary Examiner* — Minh D A

(57) ABSTRACT

A emergency light bulb for PURPOSE includes a housing that has a top wall, a bottom wall and a perimeter wall attached to and extending between the top and bottom walls. A plug is attached to and extends upwardly from the top wall. A flange is defined between the plug and the perimeter wall. The plug includes a male plug that is engageable with a female light socket. A plurality of light emitters are mounted to the housing. A control unit is electrically connected to the plug and the light emitters. A receiver for receiving a wireless signal is electrically coupled to the control unit. A transmitter is provided for sending a wireless signal to the receiver to turn on the control unit when the transmitter is actuated.

7 Claims, 4 Drawing Sheets

EMERGENCY LIGHT BULB

BACKGROUND OF THE DISCLOSURE

Field of the Disclosure

The disclosure relates to light bulbs and more particularly pertains to a new light bulb for PURPOSE.

SUMMARY OF THE DISCLOSURE

An embodiment of the disclosure meets the needs presented above by generally comprising a housing that has a top wall, a bottom wall and a perimeter wall attached to and extending between the top and bottom walls. A plug is attached to and extends upwardly from the top wall. A flange is defined between the plug and the perimeter wall. The plug includes a male plug that is engageable with a female light socket. A plurality of light emitters is mounted to the housing. A control unit is electrically connected to the plug and the light emitters. A receiver for receiving a wireless signal is electrically coupled to the control unit. A transmitter is provided for sending a wireless signal to the receiver to turn on the control unit when the transmitter is actuated.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
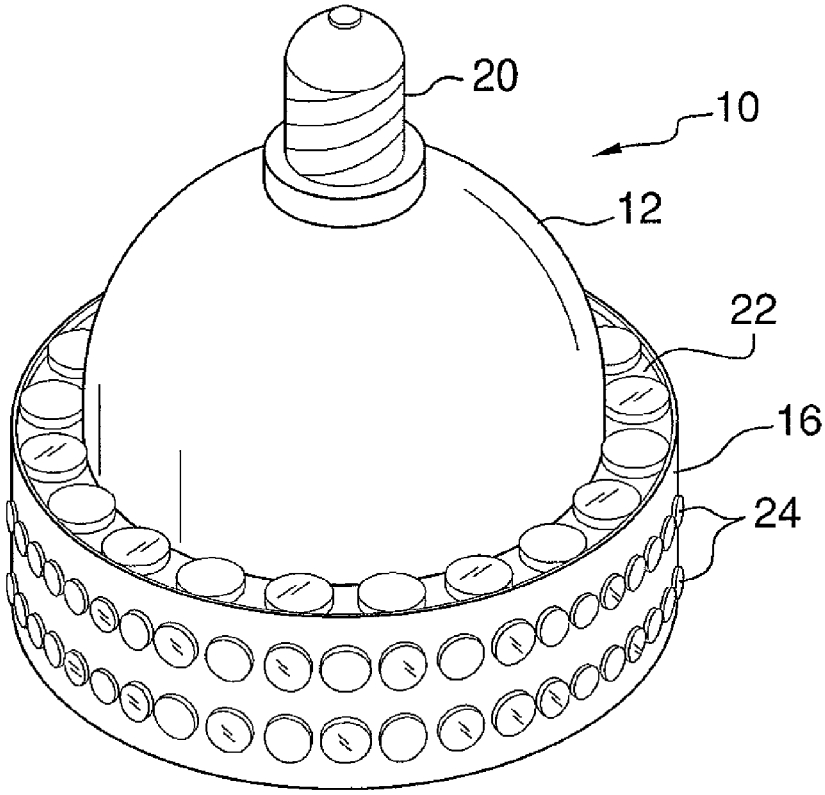
FIG. 1 is a perspective view of a emergency light bulb according to an embodiment of the disclosure.
Figure 2:
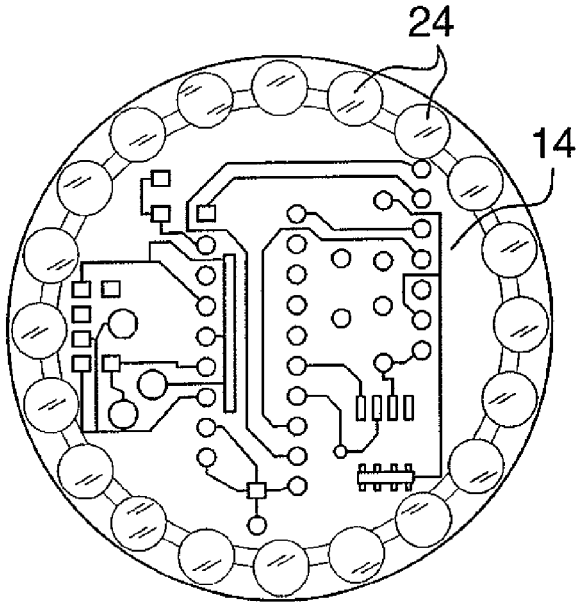
FIG. 2 is a bottom view of an embodiment of the disclosure.
Figure 3:
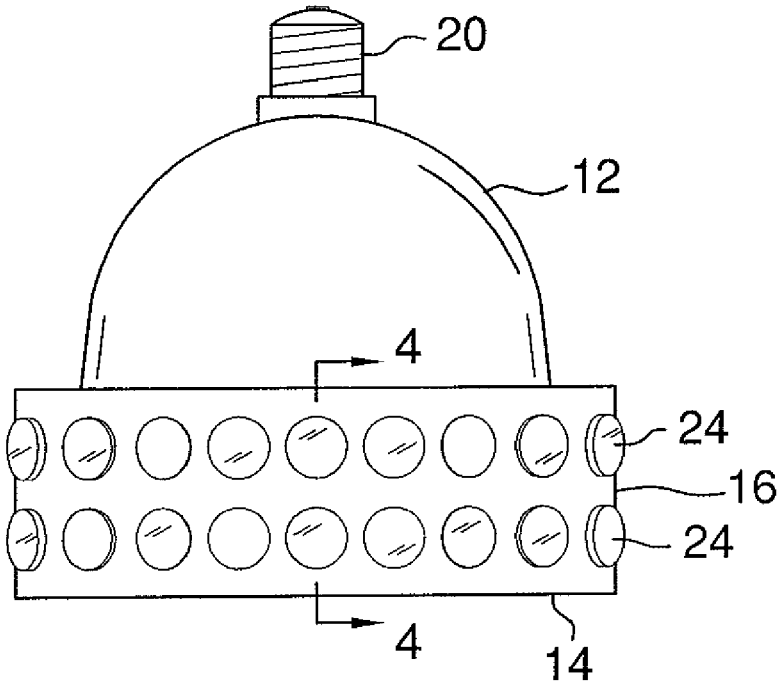
FIG. 3 is a side view of an embodiment of the disclosure.
Figure 4:
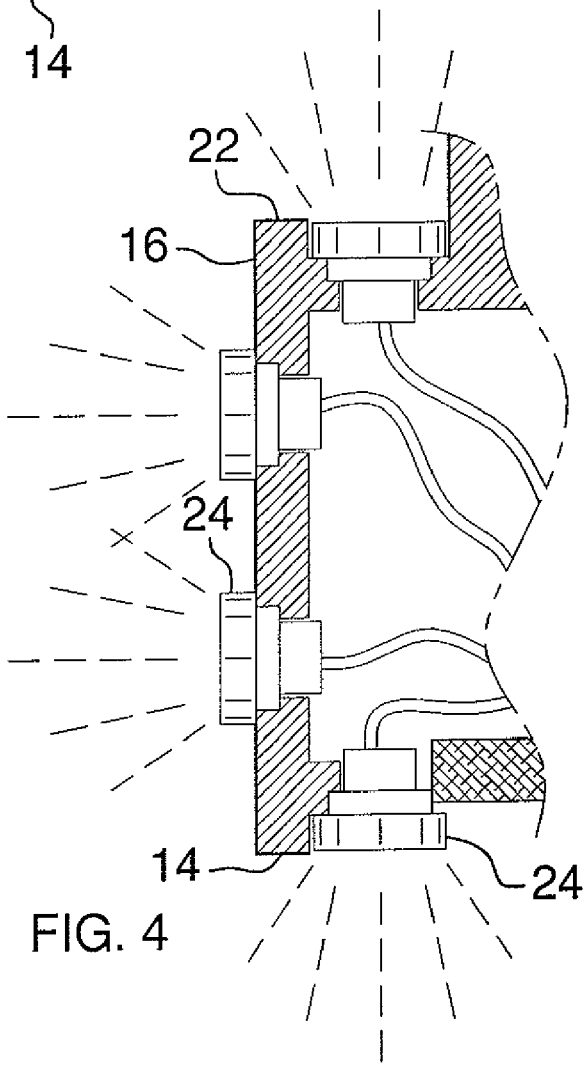
FIG. 4 is a cross-sectional view of an embodiment of the disclosure taken along the line 4-4.
Figure 5:
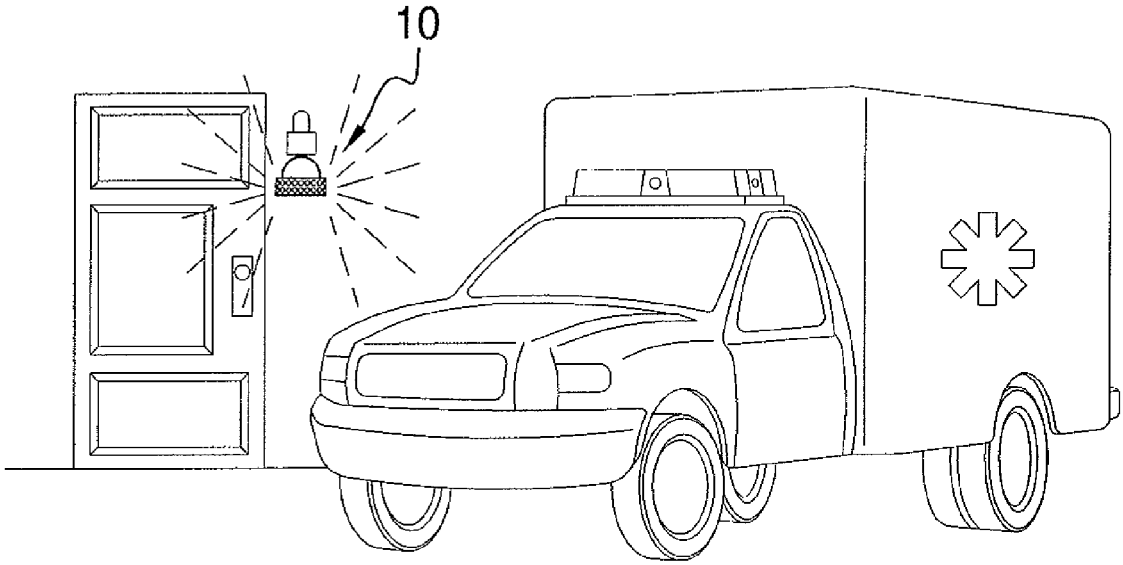
FIG. 5 is an in-use view of an embodiment of the disclosure.
Figure 6:
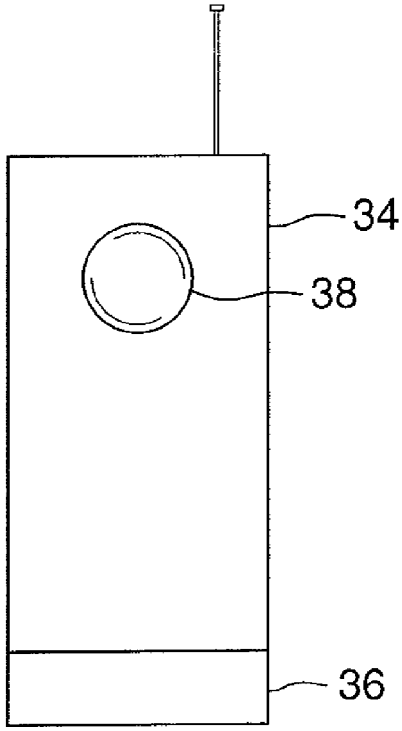
FIG. 6 is a front view of an embodiment of the disclosure.
Figure 7:
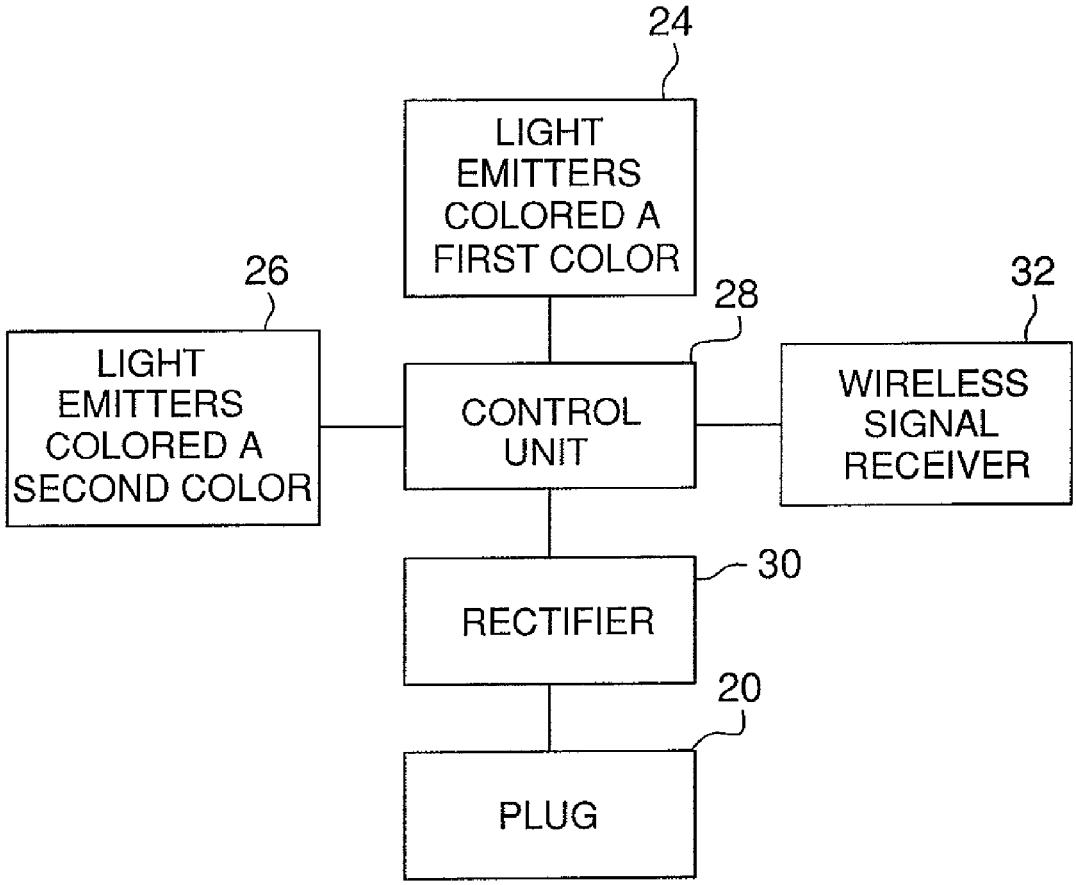
FIG. 7 is a schematic block diagram of an embodiment of the disclosure.

With reference now to the drawings, and in particular to FIGS. 1 through 7 thereof, a new light bulb embodying the principles and concepts of an embodiment of the disclosure and generally designated by the reference numeral 10 will be described.

As best illustrated in FIGS. 1 through 7, the emergency light bulb 10 generally comprises a housing that has a top wall 12, a bottom wall 14 and a perimeter wall 16 attached to and extending between the top and bottom walls. The top and bottom walls have a circular shape. The diameter of the top wall 12 may be between 1 inch and 5 inches. The diameter of the bottom wall 14 may be between 2 inches and 8 inches.

A plug 20 is attached to the top wall 12 and extends upwardly to be received by a light socket. A flange 22 is defined between the plug 20 and the perimeter wall 16. The plug 20 includes a male plug 20 to be received by a female light socket.

A plurality of light emitters 24 are mounted to the housing. Some of the light emitters 24 are positioned on the flange 22 and some of the light emitters 24 are positioned on an outer surface of the perimeter wall 16. Light emitters 24 are also positioned on the bottom wall 14 and adjacent to the perimeter wall 16. At least some of the light emitters 24 are colored a first color 24 and at least some a second color 26. The first color 24 and the second color 26 may be contrasting colors so that they are easily distinguishable from each other when flashed alternatively. The light emitters 24 colored the first color 24 are electrically coupled together so that they are capable of being activated at the same time. Likewise, the light emitters 24 colored the second color 26 are electrically coupled together. Each of the light emitters 24 includes a light emitting diode, although one skilled in the art will realize that other types of light emitters 24 may be employed.

A control unit 28 is electrically connected to the plug 18 and the light emitters 24 for supplying power to the light emitters 24. The control unit 28 includes a rectifier 30 for converting alternating current received from the plug 18 into direct current voltage to the light emitters 24 in an alternating manner so that the light emitters 24 flash between the first color 24 and the second color 26. According to an embodiment, the control unit 28 may cause the light emitters 24 to flash between red and white, in order to draw the attention of a passerby or emergency service vehicle to the emergency light bulb 10.

A receiver 32 for receiving a wireless signal is electrically coupled to the control unit 28. The wireless signal may be infrared or radio-frequency based.

A transmitter 34 is employed to send a wireless signal to the receiver 32 to turn on the control unit 28 when the transmitter 34 is actuated. The transmitter 34 may include a remote control with a power source 36 and a switch 38 to send a wireless signal to turn on the control unit 28.

In use in an emergency or other situation in which the attention of passersby may be desired, the switch 38 on the transmitter 34 is pushed to send a wireless signal to the receiver 32, which causes the control unit 28 to flash the light emitters 24 between the first color 24 and the second color 26.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. An emergency lighting system comprising:

a light emitting assembly comprising;

a housing having a top wall, a bottom wall and a perimeter wall being attached to and extending between said top and bottom walls;

a plug being attached to and extending upwardly from said top wall, a flange being defined between said plug and said perimeter wall, said plug comprising a male plug being engageable with a female light socket;

a plurality of light emitters being mounted to said housing;

a control unit being electrically connected to said plug and said light emitters, said control unit configured to supply power to said light emitters;

a receiver for receiving a wireless signal being electrically coupled to said control unit; and a transmitter for sending a wireless signal to said receiver to turn on said control unit when said wherein some of said light emitters are positioned on said flange, wherein some of said light emitters are positioned on an outer surface of said perimeter wall, wherein some of said light emitters are positioned on said bottom wall and being positioned adjacent to said perimeter wall.

2. The emergency lighting system according to claim 1, wherein said top and bottom walls having a circular shape.

3. The emergency lighting system according to claim 1, wherein at least some of said light emitters are colored a first color and at least some of said light emitters being colored a second color.

4. The emergency lighting system according to claim 3, wherein said light emitters colored a first color are electrically coupled together and said light emitters colored a second color are electrically coupled together.

5. The emergency lighting system according to claim 4, wherein said control unit includes a rectifier for converting alternating current received from said plug into direct current voltage to said light emitters in an alternating manner so that said light emitters flash between the first color and the second color.

6. The emergency lighting system according to claim 1, wherein each of said light emitters comprises a light emitting diode.

7. An emergency lighting system comprising:

a light emitting assembly comprising;

a housing having a top wall, a bottom wall and a perimeter wall being attached to and extending between said top and bottom walls, said top and bottom walls having a circular shape;

a plug being attached to and extending upwardly from said top wall, a flange being defined between said plug and said perimeter wall, said plug comprising a male plug being engageable with a female light socket;

a plurality of light emitters being mounted to said housing, some of said light emitters being positioned on said flange, some of said light emitters being positioned on an outer surface of said perimeter wall, some of said light emitters being positioned on said bottom wall and being positioned adjacent to said perimeter wall, at least some of said light emitters being colored a first color and at least some of said light emitters being colored a second color, said light emitters colored the first color being electrically coupled together, said light emitters colored the second color being electrically coupled together, each of said light emitters comprising a light emitting diode;

a control unit being electrically connected to said plug and said light emitters, said control unit configured to supply power to said light emitters, said control unit including a rectifier for converting alternating current received from said plug into direct current voltage to said light emitters in an alternating manner so that said light emitters flash between the first color and the second color;

a receiver for receiving a wireless signal being electrically coupled to said control unit; and a transmitter for sending a wireless signal to said receiver to turn on said control unit when said transmitter is actuated.

* * * * *